US005226775A

United States Patent [19]

Bohle

[11] Patent Number: 5,226,775

[45] Date of Patent: Jul. 13, 1993

[54] METHOD OF AND APPARATUS FOR CONVEYING AND STORING TABLETS, PILLS AND LIKE PRODUCTS

[75] Inventor: Lorenz B. Bohle, Ennigerloh, Fed. Rep. of Germany

[73] Assignee: L. B. Bohle Pharmatechnik GmbH, Ennigerloh, Fed. Rep. of Germany

[21] Appl. No.: 965,041

[22] Filed: Oct. 22, 1992

Related U.S. Application Data

[63] Continuation of Ser. No. 790,473, Nov. 12, 1991, abandoned.

[30] Foreign Application Priority Data

Dec. 24, 1990 [DE] Fed. Rep. of Germany ..... 4041706

[51] Int. Cl.[5] ..... B65G 1/00

[52] U.S. Cl. ..... 414/295; 414/299; 414/786; 406/84; 193/32; 222/564

[58] Field of Search ..... 193/32, 40; 198/534; 414/295, 296, 299, 293, 786; 406/84; 222/564; 141/266, 284

[56] References Cited

U.S. PATENT DOCUMENTS

| | | | |
|---|---|---|---|
| 1,021,757 | 4/1912 | Blaisdell | 414/299 X |
| 2,611,876 | 9/1952 | Hartman | 193/32 |
| 4,252,485 | 2/1981 | Propster | 414/293 X |
| 4,285,425 | 8/1981 | Smith | 193/32 X |
| 4,658,992 | 4/1987 | Peleus | 198/534 X |
| 4,754,881 | 7/1988 | Bohle | 209/557 |
| 4,755,061 | 7/1988 | Goins | 414/295 X |
| 4,984,939 | 1/1991 | Foreman et al. | 406/84 |
| 4,993,882 | 2/1991 | Nishizuka et al. | 406/84 X |
| 4,995,765 | 2/1991 | Tokuhiro et al. | 406/84 X |

FOREIGN PATENT DOCUMENTS

| | | | |
|---|---|---|---|
| 2840887 | 3/1987 | Fed. Rep. of Germany . | |
| 0042431 | 3/1982 | Japan | 414/295 |

*Primary Examiner*—Robert P. Olszewski
*Assistant Examiner*—Cheryl L. Gastineau
*Attorney, Agent, or Firm*—Peter K. Kontler

[57] ABSTRACT

Tablets, pills or like discrete products are fed into the upper section of an upright conduit to descend into a vessel under the action of gravity. Excessive acceleration of descending products is opposed by an air stream which is induced by a pump and flows in the conduit counter to the direction of advancement of the products. The vessel contains one or more partitions which have outwardly and downwardly sloping upper sides and central openings for the conduit. The outlet of the conduit discharges products first onto the bottom wall of the vessel and thereupon at a level above the lowermost partition which latter causes the products to slide outwardly toward the sidewall of the vessel. When the space between the bottom wall and the lowermost partition is filled, the lowermost partition prevents crushing of products below it under the weight of products which gather above the lowermost partition. The next higher partition performs the same function by preventing crushing of products which gather between the two lowermost partitions, and so forth. The vessel and the conduit can define a sealed endless path for the flow of a continuous air stream.

16 Claims, 1 Drawing Sheet

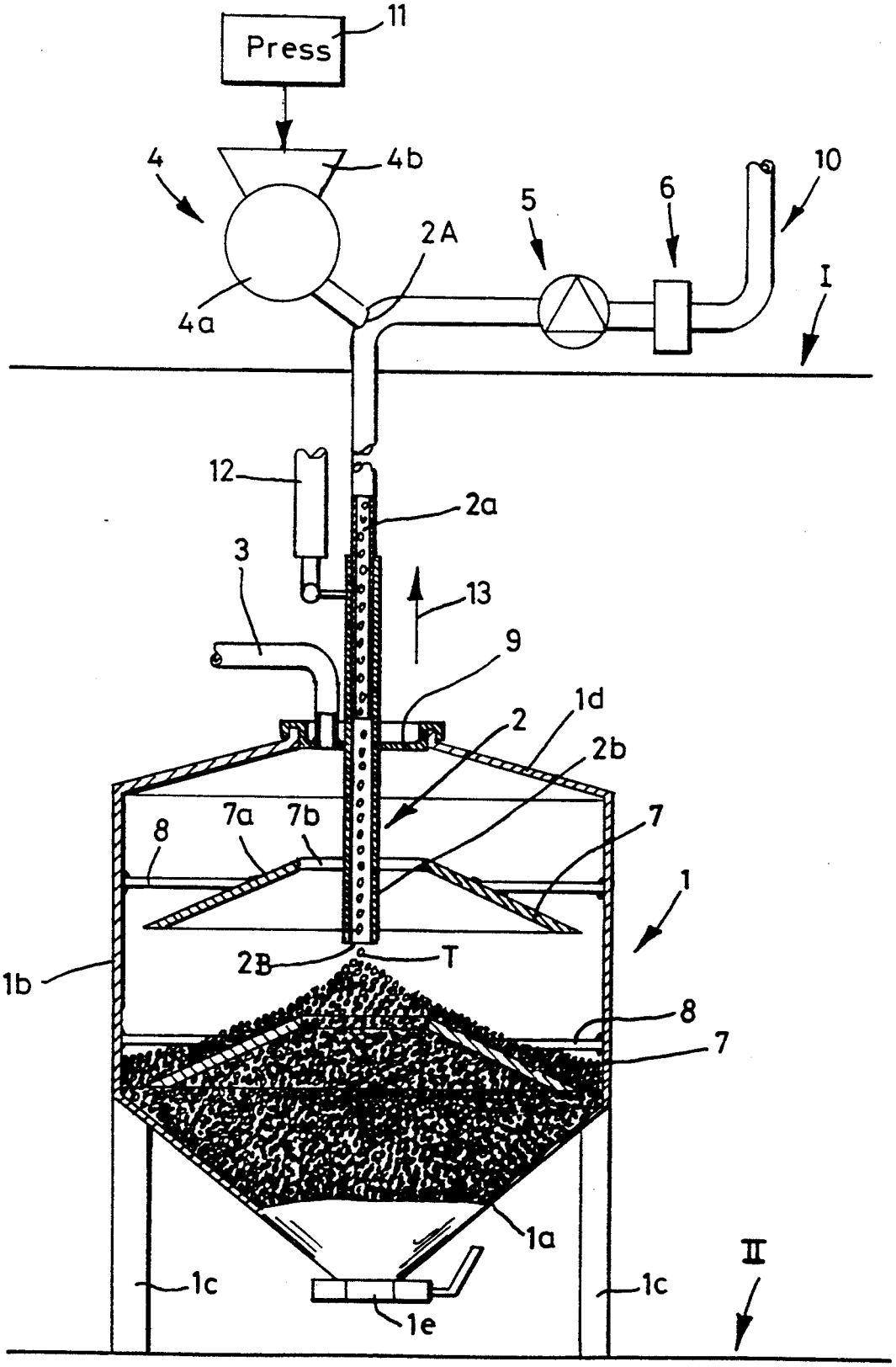
Press
11
4
4b
4a
2A
5
6
10
I
12
2a
3
13
9
1d
2
2b
7a
7b
8
7
1
1b
2B
T
8
7
1a
II
1c
1c
1e

METHOD OF AND APPARATUS FOR CONVEYING AND STORING TABLETS, PILLS AND LIKE PRODUCTS

This application is a continuation, of application Ser. No. 07/790,473, filed Nov. 12,1991 abandoned.

BACKGROUND OF THE INVENTION

The invention relates to the making and processing of tablet-shaped, pill-shaped and like or analogous discrete products (hereinafter called pills for short). More particularly, the invention relates to improvements in methods of and in apparatus for conveying and storing pills preparatory to introduction into bottles, vials, boxes or other types of containers.

It is customary to temporarily store pills between one or more making or producing machines and one or more packing or packaging machine or machines. The arrangement is frequently such that the making machine or machines are located at a higher or upper first level and that the storing facility or facilities for pills are located at a lower or second level. This renders it possible to transport the pills to the receptacle or receptacles of the storing facility or facilities by gravity feed. A drawback of presently known methods and apparatus for conveying pills by gravity feed is that the pills which descend onto a bottom wall or onto the previously conveyed pills are likely to be damaged and/or to damage the previously conveyed pills so that a relatively high percentage of pills which have been put to storage must be segregated and discarded because they are not fit for packaging and sale to customers, retailers or wholesalers. Attempts to avoid or reduce the damage to pills which are conveyed by gravity feed include the utilization of complex and expensive transporting devices, e.g., in the form of spiral chutes. This contributes to the cost of manipulation of pills downstream of the making machine or machines. Moreover, spiral chutes and like complex transporting devices occupy a substantial amount of space.

Another heretofore unsolved problem which arises in connection with the conveying and storage of pills is that such relatively brittle products cannot be stored in tall receptacles. Thus, if a receptacle contains a relatively tall column of pills, the static pressure of the upper layer or layers of pills often suffices to damage the pills in the lower layer or layers. Therefore, it is necessary to resort to a relatively large number of relatively low but wide receptacles which occupy a substantial amount of floor space. Moreover, it is often less convenient to evacuate pills from relatively short containers which have top walls rather close to the floor level.

OBJECTS OF THE INVENTION

An object of the invention is to provide a novel and improved method of conveying pills, tablets and like discrete products by gravity feed without risking damage to the conveyed products as a result of excessive acceleration.

Another object of the invention is to provide a novel and improved method of transporting tablets, pills and analogous products from a higher level to a lower level.

A further object of the invention is to provide a novel and improved method of gathering or piling up large numbers of tablets, pills and analogous discrete products in short or tall receptacles without risking damage to the products in the lower layer or layers.

An additional object of the invention is to provide a novel and improved method of manipulating pills, tablets and like discrete products between one or more making or producing machines and one or more reservoirs without any, or without appreciable damage, to the products not only during transport but also in storage.

Still another object of the invention is to provide a novel and improved apparatus for conveying pills, tablets and like discrete products by gravity feed without risking any, or without risking extensive, damage to the conveyed products.

Another object of the invention is to provide a novel and improved magazine or reservoir for temporary or longer-lasting storage of pills, tablets and like discrete products.

A further object of the invention is to provide a novel and improved combination of making, conveying and storing facilities for pills, tablets and like discrete products.

An additional object of the invention is to provide an apparatus which can be used for the manipulation of a variety of pills and/or other discrete products.

Another object of the invention is to provide an apparatus which can accept pills and like discrete products from available makers and can be utilized to safely convey such products along shorter or longer paths with the same degree of facility and with the same safety factor.

A further object of the invention is to provide an apparatus which is designed to preserve the integrity of brittle products, such as tablets or pills, during transport as well as in storage.

SUMMARY OF THE INVENTION

One feature of the present invention resides in the provision of a method of conveying a series of normally randomly distributed and/or randomly oriented discrete tablet-shaped, pill-shaped and like products (such as prescription medicine or over the counter medicine) from a higher or upper level to a lower level. The method comprises the steps of establishing for the products a path which has an inlet at the upper level and an outlet at the lower level, feeding the products of the series into the inlet of the path so that the products which are fed into the inlet descend along and leave the path through the outlet under the action of gravity, and inducing the flow of a stream of gaseous fluid along the path in a direction from the outlet toward the inlet to oppose the descent of products along the path and to thus reduce the speed of descending products.

The method can further comprise the step of collecting the products which leave the path by way of the outlet. Such collecting step preferably includes intercepting a first plurality of the products of the series at a first distance from the inlet, providing a preferably deformation-resistant partition above the first plurality of products at a lesser second distance from the inlet, and utilizing the partition for interception of a second plurality of products above the first plurality so that the partition prevents the products of the second plurality from exerting pressure upon the products of the first plurality.

Another feature of the invention resides in the provision of a method of collecting tablet-shaped, pill-shaped and like discrete (normally brittle) products in a vessel having a bottom and at least one at least substantially fixedly installed and at preferably least substantially deformation-resistant partition which is disposed above and is spaced apart from the bottom. The method comprises the step of delivering into the vessel a series of (normally randomly distributed and/or randomly oriented) discrete products by gravity flow, and such delivering step includes directing a first plurality of products of the series onto the bottom of the vessel to at least substantially fill the vessel between the bottom and the at least one partition, and thereupon directing a second plurality of products onto the at least one partition so that the at least one partition prevents the products of the second plurality from exerting pressure upon the products of the first plurality.

The delivering step can further comprise conveying the products of the series along an elongated path having an inlet at a first level and an outlet at a lower second level, and raising the outlet at a rate substantially proportionally with the rate of accumulation of products in the vessel so that the distance which the products cover on their way from the outlet onto the bottom, onto the at least one partition or onto the previously intercepted products remains at least substantially constant.

A further feature of the invention resides in the provision of an apparatus for conveying a series of discrete tablet-shaped, pill-shaped and like products from a higher level to a lower level. The improved apparatus comprises a collecting vessel at the lower level, a source of discrete products at the higher level, and at least one conduit having an inlet for reception of products from the source at the higher level and an outlet for admission of products into the vessel at the lower level so that the products which enter the inlet descend by gravity toward and enter the vessel by way of the outlet, and means (e.g., one or more vacuum pumps) for decelerating the products in the at least one conduit including means for inducing the flow of a stream of gaseous fluid (e.g., atmospheric air) in a direction from the outlet toward the inlet.

The at least one conduit can include a first section between the inlet and the outlet and a second section, and the apparatus can further comprise a filter or other suitable means for intercepting solid impurities (including fragments of and/or entire products) in the second section of the at least one conduit.

The at least one conduit and the vessel can define an endless path for circulation of the fluid stream from the outlet, through the conduit, into the vessel, back into the outlet, and so on. To this end, the vessel is or can be at least substantially sealed from the surrounding atmosphere.

An additional feature of the invention resides in the provision of an apparatus for collecting discrete tablet-shaped, pill-shaped and like products. The apparatus comprises a vessel, a conduit including a lower section having an outlet which is positioned to discharge products into the vessel and an upper section communicating with the lower section and having an inlet for reception of products from a source whereby the thus received products descend toward and enter the vessel through the outlet by gravity flow, and a pump and/or another suitable device for inducing in the conduit the flow of an air stream in a direction from the outlet toward the inlet, i.e., counter to the direction of gravitational descent of products in the conduit.

The conduit and the vessel preferably define an at least substantially sealed endless path for circulation of the air stream. Such path preferably includes a first portion between the inlet and the outlet and a second portion, and the apparatus preferably further comprises at least one filter in the second portion of the path.

The vessel includes a bottom wall or bottom and at least one partition at a level above and spaced apart from the bottom wall. The outlet is positioned to discharge products first onto the bottom wall so as to fill the vessel between the bottom wall and the at least one partition, and to thereupon discharge products onto or above the at least one partition so that the at least one partition prevents the products above it from exerting pressure upon the products between the bottom wall and the at least one partition. The vessel further includes a sidewall (e.g., an upright cylindrical sidewall) which extends upwardly from the bottom wall and surrounds the at least one partition. The latter includes a central portion and has an upper side which slopes downwardly from the central portion toward the sidewall so that the products which are discharged by the outlet onto the upper side of the at least one partition tend to slide toward the sidewall. The slope of the upper side of the at least one partition is preferably less pronounced than the angle of rest of an accumulation or pile of products.

The upper side of the at least one partition can have a substantially conical shape, a substantially pyramidal shape, a convex shape or a combination of two or more different shapes. The at least one partition can constitute or resemble an annulus, i.e., it can be provided with a central opening to permit gravitational descent of products onto the bottom wall until the vessel is filled between the bottom wall and the at least one partition.

The vessel can further comprise one or more braces, crossheads and/or other supports serving as a means for securing the at least one partition at a desired level, e.g., by securing the at least one partition to the sidewall of the vessel.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain presently preferred specific embodiments with reference to the accompanying drawing.

BRIEF DESCRIPTION OF THE DRAWING

The single Figure of the drawing is a partly elevational, partly vertical sectional and partly diagrammatic view of an apparatus which embodies the invention and can be utilized for the practice of the improved method.

DESCRIPTION OF PREFERRED EMBODIMENTS

The apparatus which is shown in the drawing serves to transport pills, tablets or like discrete products T (hereinafter again called pills for short) from a source or feeding unit 4 at a first or upper or higher level I into a collecting vessel or reservoir 1 at a lower second level II. The illustrated vessel 1 includes an upright cylindrical sidewall **1*b*, a substantially conical bottom wall or bottom 1*a* and one or more partitions 7 (two shown) within the sidewall 1*b* at different levels above the bottom wall 1*a*. The sidewall 1*b* is supported by legs 1*c*** which facilitate positioning of the vessel 1 on a suitable supporting surface at the lower level II. The illustrated vessel 1 can be stacked on top of a similar vessel and is designed to receive several pluralities or layers of discrete pills T, one above the other. The partitions 7 have central portions provided with openings 7b and upper sides 7a which slope downwardly from the respective openings 7b toward the inner side of the sidewall 1b. The illustrated partitions 7 have frustoconical upper sides 7b; however, it is equally possible to employ one or more partitions having pyramidal, slightly convex or otherwise shaped upper sides which induce the pills T thereon to slide downwardly and outwardly. The reference characters 8 denote braces, crossheads or analogous supports which serve to secure the partitions 7 to the sidewall 1b of the vessel 1. The vessel 1 still further comprises a conical top wall or lid 1d which is integral with the upper end of the sidewall 1b and includes a detachable central portion 9. The bottom wall 1a has a centrally located sealable product-discharging device 1e which is of conventional design and forms no part of the present invention. The device 1e is actuated to permit evacuation of gathered pills T, for example, into a packing or classifying machine, e.g., into a machine described and shown in commonly owned U.S. Pat. No. 4,754,881 granted Jul. 5, 1988 for "Apparatus for classifying objects according to their lengths".

Each of the illustrated partitions 7 resembles an annulus having a maximum diameter which is at least slightly smaller than the inner diameter of the upright cylindrical sidewall 1b. More specifically, the illustrated partitions 7 resemble unslotted diaphragm springs and are sufficiently stable or rigid to carry the weight of a substantial supply of pills T without any or with a minimum of deformation. The slope of the upper sides 7b of the partitions 7 is preferably less than the angle of rest of an accumulation or pile of pills T. This is desirable and advantageous because, as soon as the vessel 1 is filled with pills T between the bottom wall 1a and the lower partition 7 and the vessel continues to receive a series of randomly distributed and/or randomly oriented pills T, such pills can readily slide and/or roll along the upper side 7a of the lower partition 7 to more predictably fill the respective portion of the vessel 1. The same holds true when the vessel 1 is filled all the way to the level of the central opening 7b in the upper partition 7 and the vessel continues to receive pills T. The orientation of the pills T is of no consequence if the pills have a spherical shape.

The lower partition 7 not only ensures highly predictable and complete filling of lower portion of the vessel 1 with pills T but it also serves the additional purpose of preventing crushing of and/or similar damage to pills T in the space between the bottom wall 1a and the lower partition 7 by the pills in the space between the two partitions. Analogously, the upper partition 7 shields the supply or accumulation of pills T from damage under the combined weight of pills T which gather above the upper side 7a of the upper partition. Thus, the vessel 1 can accumulate a relatively tall or very tall column of pills T without risking damage to pills close to the bottom wall 1a by the pills above them.

The central portion 9 of the cover or lid 1d is traversed by the preferably vertical lower section 2b of a conduit 2 which further includes an upper section 2a partially and preferably sealingly telescoped into the lower section 2b. The open lower end 2B of the section 2b constitutes an outlet which discharges pills T into the interior of the vessel 1, and the upper section 2a has an inlet 2A which receives pills T from the feeding unit 4. The latter can comprise a driven cell wheel 4a and a funnel 4b receiving pulls T from a press 11 or another of the present invention. The rotary cell wheel 4a permits entry of pills T into the section 2a but seals the interior of the conduit 2 from the atmosphere at the locus of the inlet 2A. The apparatus can further comprise a mechanism (e.g., a fluid-operated cylinder and piston unit 12) which serves to move the section 2b up and down so that the outlet 2B descends at a rate which is at least substantially proportional to the rate of filling the vessel 1 with pills T. This ensures that the distance which individual pills T cover on their way from the outlet 2B to the bottom wall 1a or onto the pills T below it is at least substantially constant and does not exceed a distance which would suffice to enable the descending pills to crush the pills below them or to be damaged on impact against the bottom wall 1a or against the pills which are already confined in the vessel 1. The exact manner in which the upward movement of the section 2b is synchronized with the rate of filling of the vessel 1 with pills T forms no part of the invention; for example; the apparatus can include one or more photosensitive detectors or other devices which monitor the level of the supply of pills T in the vessel 1 and generate signals which are transmitted to the controls for the cylinder and piston unit 12.

The unit 12 can further serve to lift the section 2b of the conduit 2 above and away from the central portion 9 of the cover or lid 1d.

The conduit 2 preferably forms part of a composite conduit which further includes a pipe 10 integral with or separably affixed to the section 2a and having an end portion 3 which admits air or another suitable gaseous fluid into the interior of the vessel 1. The composite conduit 2, 3, 10 and the vessel 1 preferably define an endless path for the circulation of a stream of air in the direction of arrow 13, namely in a direction from the outlet 2B toward and past the inlet 2A. To this end, the vessel 1 is at least substantially sealed from the surrounding atmosphere, the same as the interior of the composite conduit 2, 3, 10.

The means for inducing the flow of an air stream in the direction of arrow 13 includes a yacuum pump 5 which is installed in the conduit 10 and is located upstream of an air filter 6 serving to intercept solid impurities (such as fragments of pills T, entire pills T and/or dust) for intermittent evacuation from the endless path. The illustrated filter 6 can be used jointly with, or it can be replaced by, a filter (not shown) between the inlet 2A and the pump 5. A filter between the inlet 2A and the pump 5 exhibits the advantage that it prevents penetration of solid impurities into the pump.

The pump 5 is preferably adjustable so that it can be set up to induce an optimum flow of an air stream which rises in the conduit 2 to oppose the gravitational descent of pills T from the inlet 2A toward and through the outlet 2B, i.e., to brake the descending pills T and to thus further reduce the likelihood of damage to pills which have entered the vessel 1 to descend directly onto the bottom wall 1a or onto a layer of pills which are already confined in the interior of the vessel.

The mode of operation of the illustrated apparatus is as follows:

The press 11 delivers pills T into the funnel 4b which, in turn, admits the pills into the cell wheel 4a of the feeding unit or source 4. The cell wheel 4a admits pills T into the inlet 2A so that the pills descend in the conduit 2 by gravity and reach a speed which is determined by the ascending air stream induced by the pump 5 and flowing along the endless path as indicated by the arrow 13. The unit 4 is preferably designed to deliver pills T at an at least substantially constant rate so that the conduit 2 receives a predetermined number of pills per unit of time. The ascending air stream not only brakes or decelerates the pills T on their way from the inlet 2A toward the outlet 2B but such air stream also extracts solid impurities from the vessel 1 and from the conduit 2 to deliver such impurities to the filter 6.

An important advantage of the improved methods and apparatus is that it is possible to fill a tall vessel 1 without risking damage to (e.g., squashing or crushing of) pills T close to the bottom wall 1*a* under the weight of the pills T above them.

Another important advantage of the improved methods and apparatus is that the pills T are not likely to be damaged on impact against the pills beneath the outlet 2B of the lower section 2*b* of the conduit 2. This is due to the fact that the pump 5 can induce the flow of an air stream which opposes excessive acceleration of descending pills T during descent of such pills from the level of the inlet 2A to the level of the outlet 2B.

The partition of partitions 7 exhibit the advantage that they ensure predictable filling of the corresponding portions of the internal space of the vessel 1 and prevent crushing of pills T in the lower part of the vessel under the combined weight of the pills above them. The number of partitions 7 or analogous partitions can be reduced to one or increased to three or more. The partition or partitions will or can have a polygonal outline, for example, if the illustrated vessel 1 (having a cylindrical sidewall 1*b*) is replaced with a vessel having a polygonal sidewall.

The establishment of an endless path for the circulation of an air stream constitutes an advantageous but optional feature of the invention. Thus, the part 3 can draw fresh air from the surrounding atmosphere and the conduit 10 can discharge air into the atmosphere downstream of the filter 6. Such modification will be readily understood by those skilled in the art without additional illustrations.

German Pat. No. 28 40 887 to Boehringer Mannheim GmbH (published Apr. 3, 1980) discloses an apparatus which is designed to transport elongated test strips in a gaseous carrier medium so that the test strips are actually advanced by the gaseous fluid to enter a collecting or gathering station. The purpose of the stream of gaseous fluid is to transport the test strips in substantial parallelism with each other and to thus reduce the likelihood of clogging of the passage for transport of the test strips. This patent does not suggest the utilization of a stream of gaseous fluid as a means for preventing excessive acceleration of pellets, pills, tablets and like discrete solid particles under the action of gravity during gravitational descent from a higher level to a lower level.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A method of collecting substantially tablet-shaped discrete products in a vessel having a bottom and at least one fixedly installed partition which is disposed above and is spaced apart from the bottom, comprising the steps of delivering into the vessel a series of products by gravity flow including directing a first plurality of products of said series directly onto the bottom to at least substantially fill the vessel between the bottom and the at least one partition, and thereupon directing a second plurality of products onto the at least one partition so that the at least one partition prevents the products of the second plurality from exerting pressure upon the products of the first plurality.

2. The method of claim 1, wherein said delivering step further comprises conveying the products of said series along an elongated path having an inlet at a first level and an outlet at a lower second level, and raising the outlet substantially proportionately with the rate of accumulation of products in the vessel.

3. Apparatus for conveying a series of substantially tablet-shaped discrete products from a higher level to a lower level, comprising a collecting vessel for simultaneous storage of a plurality of products at said lower level; a source of products at said higher level; at least one conduit having an inlet for reception of products from said source at said higher level and an outlet for admission of products into said vessel at said lower level so that the products which enter said inlet descend by gravity toward and enter the vessel by way of said outlet; and means for decelerating the products in said at least one conduct including means for inducing the flow of a stream of gaseous fluid in a direction from said outlet toward said inlet.

4. The apparatus of claim 3, wherein said vessel is at least substantially sealed from the surrounding atmosphere.

5. Apparatus for collecting substantially tablet-shaped discrete products, comprising a vessel for simultaneous confinement of a plurality of products; a conduit including a lower section having an outlet positioned to discharge products into said vessel and an upper section communicating with said lower section and having an inlet for reception of products from a source whereby the thus received products descend toward and enter the vessel through said outlet by gravity flow; and a device for inducing in said conduit the flow of an air stream in a direction from said outlet toward said inlet counter to the direction of gravitational descent of the products in said conduit.

6. Apparatus for collecting substantially tablet-shaped discrete products, comprising a vessel; a conduit including a lower section having an outlet positioned to discharge products into said vessel and an upper section communicating with said lower section and having an inlet for reception of products from a source whereby the thus received products descend with substantial clearance toward and enter the vessel through said outlet by gravity flow; and a device for inducing in said conduit the flow of an air stream in a direction from said outlet toward said inlet counter to the direction of gravitational descent of products in said conduit, said conduit and said vessel defining a substantially sealed endless path for circulation of the air stream.

7. The apparatus of claim 6, wherein said path includes a first portion between sad inlet and said outlet and a second portion, and further comprising at least one air filter in the second portion of said path.

8. Apparatus for collecting substantially tablet-shaped discrete products, comprising a vessel including a bottom wall and at least one partition at a level above and spaced apart from said bottom wall; a conduit including a lower section having an outlet positioned to discharge products into said vessel and an upper section communicating with said lower section and having an inlet for reception of products from a source whereby the thus received products descend with substantial clearance toward and enter the vessel by gravity flow, said outlet being positioned to discharge products first onto said bottom wall so as to fill the vessel between said bottom wall and a said at least one partition, and to thereupon discharge products above said at least one partition so that such partition prevents the products thereabove from exerting pressure upon the products between said bottom wall and said at least one partition; and a device for inducing in said conduit the flow of an air stream in a direction from said outlet toward said inlet counter to the direction of gravitational descent of products in said conduit.

9. The apparatus of claim 8, wherein said vessel has a sidewall extending upwardly from said bottom wall and surrounding said at least one partition, said at least one partition including a central portion and having an upper side which slopes downwardly from said central portion toward said sidewall so that the products which said outlet discharges onto said upper side tend to slide toward said sidewall.

10. The apparatus of claim 9, wherein the slope of said upper side is less pronounced than the angle of rest of an accumulation of said products.

11. The apparatus of claim 9, wherein said upper side has a substantially conical shape.

12. The apparatus of claim 8, wherein said at least one partition has an annular shape.

13. The apparatus of claim 8, wherein said vessel further comprises a sidewall extending upwardly from said bottom wall and surrounding said at least one partition, and means for securing said at least one partition to said sidewall.

14. A method of conveying a series of discrete substantially tablet-shaped products from a higher level to a lower level, comprising the steps of establishing for the products a path which has an inlet at the upper level and an outlet at the lower level; feeding the products of the series into the inlet of said path so that the products thus fed descend with substantial clearance along and leave the path through the outlet under the action of gravity; inducing the flow of a stream of gaseous fluid along said path in a direction from the outlet toward the inlet to oppose the descent of products along said path and to thus reduce the speed of descending products; and collecting the products which leave said path by way of the outlet, including intercepting a first plurality of the products of said series at a first distance from the inlet, providing a substantially deformation-resistant partition above the first plurality of a lesser second distance from the inlet, and utilizing the partition for interception of a second plurality of products above the first plurality so that the partition prevents the products of the second plurality from exerting pressure upon the products of the first plurality.

15. Apparatus for conveying a series of substantially tablet-shaped discrete products from a higher level to a lower level, comprising a collecting vessel at said lower level; a source of products at said higher level; at least one conduit having an inlet for reception of products from said source at said higher level and an outlet for admission of products into said vessel at said lower level so that the products which enter said inlet descend by gravity with substantial clearance toward and enter the vessel by way of said outlet, said at least one conduit including a first portion between said inlet and said outlet and a second portion; means for intercepting solid impurities, including fragments of products, in the second portion of said at least one conduit; and means for decelerating the products in said at least one conduit, including means for inducing the flow of a stream of gaseous fluid in a direction from said outlet toward said inlet.

16. Apparatus for conveying a series of substantially tablet-shaped discrete products from a higher level to a lower level, comprising a collecting vessel at said lower level; a source of products at said higher level; at least one conduit having an inlet for reception of products from said source at said higher level and an outlet for admission of products into said vessel at said lower level so that the products which enter said inlet descend by gravity with substantial clearance toward and enter the vessel by way of said outlet; and means for decelerating the products in said at least one conduit, including means for inducing the flow of a stream of gaseous fluid in a direction from said outlet toward said inlet, said at least one conduit and said vessel defining an endless path for circulation of said fluid stream.

* * * * *